US006316127B1

(12) United States Patent
Ikeda et al.

(10) Patent No.: US 6,316,127 B1
(45) Date of Patent: Nov. 13, 2001

(54) GALVANIZED STEEL SHEET SUPERIOR IN DUCTILITY AND PROCESS FOR PRODUCTION THEREOF

(75) Inventors: Shushi Ikeda; Koichi Makii; Yosuke Shindo, all of Kobe; Shunichi Hashimoto; Takahiro Kashima, both of Kakogawa, all of (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/553,962

(22) Filed: Apr. 20, 2000

(30) Foreign Application Priority Data

Apr. 27, 1999 (JP) ..... 11-119942

(51) Int. Cl.[7] ..... B32B 15/18; B05D 1/18

(52) U.S. Cl. ..... 428/659; 148/533; 427/433; 427/436; 428/939

(58) Field of Search ..... 428/659, 939; 427/433, 436; 148/533

(56) References Cited

FOREIGN PATENT DOCUMENTS

| | | |
|---|---|---|
| 4-157143 | 5/1992 | (JP) . |
| 4-276027 | 10/1992 | (JP) . |
| 4-314828 | 11/1992 | (JP) . |
| 5-105963 | 4/1993 | (JP) . |
| 5-112858 | 5/1993 | (JP) . |
| 5-117834 | 5/1993 | (JP) . |
| 5-125485 | 5/1993 | (JP) . |
| 5-132748 | 5/1993 | (JP) . |
| 5-247539 | 9/1993 | (JP) . |
| 5-331612 | 12/1993 | (JP) . |
| 5-345953 | 12/1993 | (JP) . |
| 6-17142 | 1/1994 | (JP) . |
| 6-2100 | 1/1994 | (JP) . |
| 6-33214 | 2/1994 | (JP) . |
| 6-21334 | 3/1994 | (JP) . |
| 6-57336 | 3/1994 | (JP) . |
| 6-81100 | 3/1994 | (JP) . |
| 6-81101 | 3/1994 | (JP) . |
| 6-81103 | 3/1994 | (JP) . |
| 6-108157 | 4/1994 | (JP) . |
| 6-158172 | 6/1994 | (JP) . |
| 6-248349 | 9/1994 | (JP) . |
| 7-34135 | 2/1995 | (JP) . |
| 8-53744 | 2/1996 | (JP) . |
| 2515139 | 4/1996 | (JP) . |
| 2549539 | 8/1996 | (JP) . |
| 9-209106 | 8/1997 | (JP) . |
| 9-235652 | 9/1997 | (JP) . |
| 10-17983 | 1/1998 | (JP) . |
| 10-17994 | 1/1998 | (JP) . |
| 10-130737 | 5/1998 | (JP) . |

*Primary Examiner*—Robert R. Koehler
(74) *Attorney, Agent, or Firm*—Oblon, Spivak, McClelland, Maier & Neustadt, P.C.

(57) ABSTRACT

A P- and Ti-added galvannealed steel sheet superior in ductility, and a process for production thereof. It is made of a cold-rolled steel sheet and has alloyed hot-dip galvanizing on the surface thereof, said cold-rolled steel sheet having the chemical composition (in terms of wt %) of C: less than 0.010%, Si: no more than 0.5%, Mn: 1.0~3.0%, P: no more than 0.20%, S: no more than 0.01%, Al: 0.005~0.10%, N: no more than 0.0050%, Ti/48−(C/12+N/14+S/32): 0.0003~0.0018 with the remainder being chiefly Fe, and said cold-rolled steel sheet being characterized by $\rho 1 \leqq 10^7$ and $\rho 2 \leqq 5\times10^5$, where ρ1 is the number of precipitates whose particle diameter (D) is in the range of 10 nm≦D<100 nm and ρ2 is the number of precipitates whose particle diameter (D) is in the range of 100 nm≦D.

8 Claims, 4 Drawing Sheets

GALVANIZED STEEL SHEET SUPERIOR IN DUCTILITY AND PROCESS FOR PRODUCTION THEREOF

BACKGROUND OF THE INVENTION

1. Field of the Invention

The present invention relates to a P- and Ti-added galvannealed steel sheet which has high strength and good ductility. The present invention relates also to a process for producing said galvannealed steel sheet.

2. Description of the Related Art

Automotive steel sheet often calls for good press workability as well as good corrosion resistance. Steel sheet meeting these requirements is exemplified by galvannealed steel sheet. This steel sheet is formed from a cold-rolled steel sheet (as base material) by hot-dip galvanizing and heat treatment at about 600° C. for improvement in adhesion between the plated layer and the base material. This heat treatment turns the plated layer into alloy.

For improvement of galvannealed steel sheet in press workability, it is necessary to improve adhesion between the plated layer and the steel sheet (as base material) and it is also necessary to improve the press workability of the steel sheet itself. For the steel sheet to have good deep drawability, the base material should be Ti-added killed steel sheet in which carbon in the steel solid solution is fixed by titanium.

Recent automobiles strongly call for weight reduction for improvement in fuel efficiency. The base material for galvannealed steel sheet calls for press workability as well as higher strength. The latter requirement is usually met by adding a solid solution hardening element (such as P, Mn, and Si) as disclosed in Japanese Patent Publication No. 21334/1994.

OBJECT AND SUMMARY OF THE INVENTION

A galvannealed steel sheet made from a Ti-added killed steel which has undergone solid solution strengthening with P was found to greatly decrease in ductility despite the fact that C in solid solution in steel is fixed by Ti addition. Decreased ductility leads to defective forming of automotive steel sheet (particularly interior plates and members requiring ductility), which lowers productivity.

The present invention was completed in view of the foregoing. It is an object of the present invention to provide a P- and Ti-added galvannealed steel sheet having good ductility and a process for production of the same.

DESCRIPTION OF THE PREFERRED EMBODIMENTS

Figure 1:
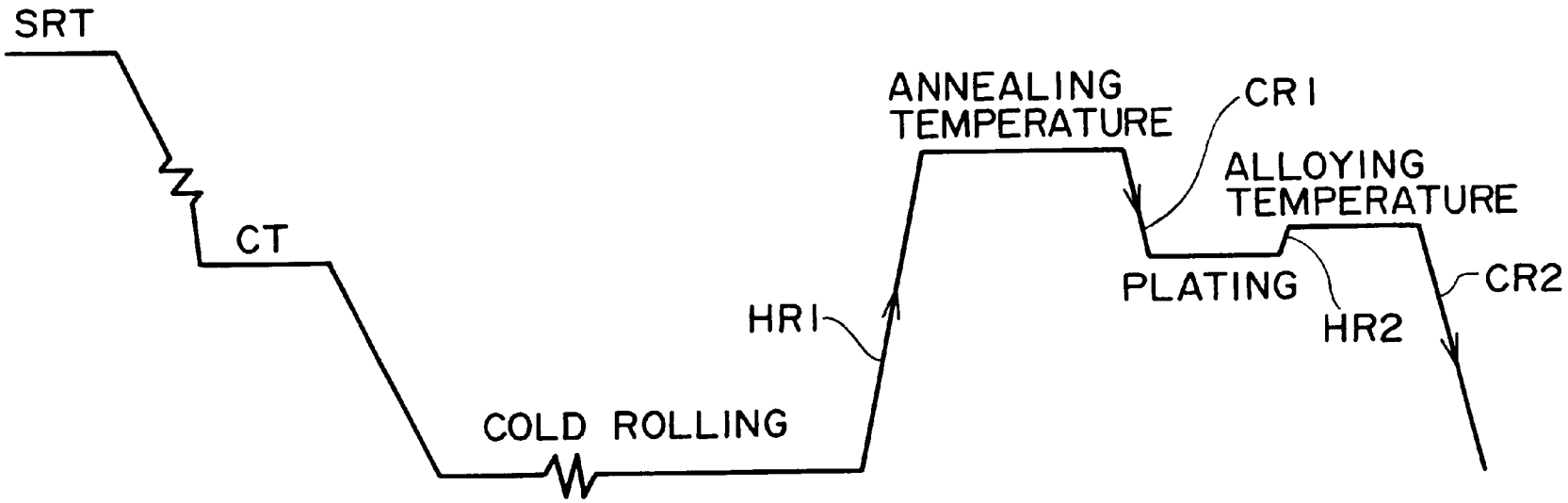
FIG. 1 is a heat treatment diagram showing the production process of galvannealed steel sheet.

The present inventors extensively studied the cause to deteriorate the ductility of P- and Ti-added galvannealed steel sheet. As the result, they found that FeTiP precipitate in large amount in the structure during plating treatment and alloying treatment and these precipitates greatly deteriorate ductility. This finding led to the present invention.

The first aspect of the present invention resides in a galvannealed steel sheet superior in ductility which is made of a cold-rolled steel sheet and has alloyed hot-dip galvanizing on the surface thereof, said cold-rolled steel sheet having the chemical composition (in terms of wt %) of:

C: less than 0.010%,
Si: no more than 0.5%,
Mn: 1.0~3.0%,
P: no more than 0.20%,
S: no more than 0.01%,
Al: 0.005~0.10%,
N: no more than 0.0050%,
Ti/48−(C/12+N/14+S/32):0.0003~0.0018 with the remainder being chiefly Fe, and said cold-rolled steel sheet being characterized by:

$\rho 1 \leqq 10^7$ and $\rho 2 \leqq 5\times 10^5$, where $\rho 1$ is the number of precipitates whose particle diameter (D) is in the range of 10 nm$\leqq$D$\leqq$100 nm and $\rho 2$ is the number of precipitates whose particle diameter (D) is in the range of 100 nm$\leqq$D.

A detailed description will be given below of the galvannealed steel sheet of the present invention. First, an explanation is given of the reason to restrict the composition (in terms of wt %) of the cold-rolled steel sheet as the base material.

C: Less Than 0.010%

The amount of C should be as small as possible for improvement in press workability. As the amount of C increases, the amount of carbide or nitride-forming elements (such as Ti, Nb, and Zr) required to fix C increases. This raises production cost, increases the amount of precipitates, and deteriorates ductility. Therefore, according to the present invention, the amount of C should be less than 0.010%, preferably less than 0.005%.

Si: No More Than 0.5%

Si is an element for solid solution hardening, which contributes to improvement in the strength of steel sheet. When added in an excess amount, it greatly impairs the adhesion of hot-dip galvanizing. Therefore, according to the present invention, the upper limit of the amount of Si should be 0.5%, preferably 0.2%.

Mn: 1.0~3.0%

Mn is an element for solid solution hardening, which increases steel strength. According to the present invention, the lower limit of the amount of Mn should be 1.0%, preferably 1.2%, and the upper limit of the amount of Mn should be 3.0%, preferably 2.0%. An excess amount deteriorates the adhesion of plating.

P: No More Than 0.20%

P is an inexpensive element for solid solution hardening and hence it a useful element to increase steel strength. It should be added in an amount more than 0.03% for strengthening; however, when added in an excess amount, it precipitates a large amount of FeTiP harmful to ductility. Therefore, according to the present invention, the upper limit of the amount of P should be 0.20%, preferably 0.15%, and more preferably 0.10%.

S: No More Than 0.01%

S gives rise to such precipitates as MnS, $Ti_4C_2S_2$, and ZrS and deteriorates ductility. Therefore, its amount should be as small as possible. According to the present invention, the amount of S should be no more than 0.01%.

Al: 0.005~0.10%

Al functions mainly as a deoxidizing agent. It should be added in an amount of at least 0.005%. Al added in an excess amount does not increase the deoxidizing effect but deteriorates ductility due to alumina-based inclusions and also impairs productivity due to nozzle clogging in continuous casting. Therefore, according to the present invention, the upper limit of the amount of Al should be 0.10%.

N: No More Than 0.0050%

As the content of N increases, it is necessary to add more nitride-forming element to fix N, which leads to an increased production cost and an adverse effect on ductility. Therefore, the amount of N should be as small as possible. According to the present invention, the upper limit of the amount of N should be 0.0050%, preferably 0.0030%.

Ti/48−(C/12+N/14+S/32):0.0003~0.0018

The value defined by Ti/48−(C/12+N/14+S/32) is the theoretical amount of Ti in steel, with C, N, and S therein fixed by Ti. If this value is less than 0.0003, the resulting steel sheet is poor in deep drawability (r value) due to insufficient fixing by Ti. On the other hand, if this value exceeds 0.0018, the resulting steel sheet is poor in ductility due to FeTiP which occurs easily. Therefore, according to the present invention, the lower limit of this value should be 0.0003, preferably 0.0005, and the upper limit of this value should be 0.0018, preferably 0.0010.

The cold-rolled steel sheet from which the galvannealed steel sheet of the present invention is made contains Fe as the principal component in addition to the above-mentioned basic components. The principal component is composed of Fe and inevitable impurities. It may also contain other elements not harmful to the basic components and other elements to improve the characteristic properties of the material. The examples of the latter elements will be explained later.

A mention will be made below of the size and number of precipitates in the cold-rolled steel sheet as the base material.

A steel in which P and Ti coexist has a precipitation peak temperature for FeTiP. Therefore, even though the hot-rolled sheet is wound up at a low temperature so as to suppress precipitation of FeTiP, there is the possibility that FeTiP precipitates in large amount in the annealing step, hot-dip galvanizing step, and alloying step that follow the cold rolling. This FeTiP impairs ductility. Consequently, it is possible to improve ductility by controlling the amount of precipitates composed mainly of FeTiP. Ductility is correlated to the amount of precipitates. If comparatively fine precipitates (10~100 nm) are present in a large amount, the steel sheet tends to decrease in uniform elongation. If comparatively coarse precipitates (larger than 100 nm) are present, the steel sheet tends to decrease in local elongation no matter how small their amount is. Therefore, it is necessary to control the amount of both fine and coarse precipitates.

According to the present invention, the number and size of precipitate are controlled such that $\rho1 \leqq 10^7$ and $\rho2 \leqq 5\times10^5$, where $\rho1$ is the number of precipitates whose particle diameter (D) is in the range of 10 nm$\leqq$D$\leqq$100 nm and $\rho2$ is the number of precipitates whose particle diameter (D) is in the range of 100 nm$\leqq$D. If $\rho1>10^7$, the steel sheet is poor in uniform elongation and ductility. Therefore, precipitates should be controlled such that $\rho1 \leqq 10^7$, preferably $\rho1 \leqq 5\times10^5$. On the other hand, if $\rho2>5\times10^5$, the steel sheet is poor in local elongation and ductility. Thus, precipitates should be controlled such that $\rho2 \leqq 5\times10^5$. Only if $\rho1$ and $\rho2$ satisfy the foregoing conditions, the steel has balanced uniform elongation and local elongation and exhibits good ductility for press working.

The second aspect of the present invention resides in a galvannealed steel sheet superior in ductility which is made of a cold-rolled steel sheet and has alloyed hot-dip galvanizing on the surface thereof, said cold-rolled steel sheet having the chemical composition (in terms of wt %) of:

C: less than 0.010%,

Si: no more than 0.5%,

Mn: 1.0~3.0%,

P: no more than 0.20%,

S: no more than 0.01%,

Al: 0.005~0.10%,

N: no more than 0.0050%,

Zr: no more than 0.10% and/or Nb: no more than 0.10%,

Ti/48+Zr/91+Nb/93−(C/12+N/14+S/32):0.0003~0.0018 with the remainder being chiefly Fe, and said cold-rolled steel sheet being characterized by:

$\rho1 \leqq 10^7$ and $\rho2 \leqq 5\times10^5$, where $\rho1$ is the number of precipitates whose particle diameter (D) is in the range of 10 nm$\leqq$D<100 nm and $\rho2$ is the number of precipitates whose particle diameter (D) is in the range of 100 nm$\leqq$D.

The galvannealed steel sheet defined above in the second aspect is identical with that defined in the first aspect except that the cold-rolled steel sheet as the base material contains Zr and/or Nb (as carbide-forming elements) together with Ti. The amounts of these elements are limited for the following reasons.

Zr: No More Than 0.10%, Nb: No More Than 0.10%

Like Ti, Zr and Nb fix C to form ZrC and NbC, thereby improving the deep drawability of steel sheet. However, if added excessively, they increase production cost and prevent recrystallization, thereby impairing ductility. Therefore, according to the present invention, the upper limit of the amount of these elements should be 0.10%, preferably 0.05%, more preferably 0.03%.

Ti/48+Zr/91+Nb/93−(C/12+N/14+S/32):0.0003~0.0018

The value defined by Ti/48+Zr/91+Nb/93−(C/12+N/14+S/32) is the theoretical amount of Ti in steel, with C, N, and S therein fixed by Zr, Nb, and Ti. If this value is less than 0.0003, the resulting steel sheet is poor in deep drawability (r value) due to insufficient fixing by Ti. On the other hand, if this value exceeds 0.0018, the resulting steel sheet is poor in ductility due to FeTiP which occurs easily. Therefore, according to the present invention, the lower limit of this value should be 0.0003, preferably 0.0005, and the upper limit of this value should be 0.0018, preferably 0.0010, provided that Ti>0%.

The cold-rolled steel sheet from which the galvannealed steel sheet pertaining to the second aspect of the present invention is made contains Fe as the principal component, and C, Si, Mn, P, S, Al, N, Ti, at least one species of Zr, Nb as the basic components. The principal component has the same meaning as that in explained in the first aspect. It may also contain other elements to improve the properties of the material. For example, the principal component may be incorporated with B in an amount specified below. B raises the strength of steel to 340~590 MPa.

B: 0.0002~0.0030%

If C in solid solution is fixed with Ti or the like, the resulting steel sometimes decreases in intergranular strength, leading to intergranular fracture. B as a substitute of C strengthens the grain boundary, suppresses intergranular fracture, increases ductile fracture ratio, and eventually improves ductility. It greatly contributes to the strengthening of steel containing C in an extremely small amount. For B to produce its effect of improving strength, the lower limit of the amount of B should be 0.0002%, preferably 0.0005%, and the upper limit of the amount of B should be 0.0030%, preferably 0.0020%.

The third aspect of the present invention is a process for producing the galvannealed steel sheet mentioned above in the first and second aspects. This process comprises heating to 1100~1250° C. a billet having the chemical composition mentioned in the first or second aspect, hot-rolling the billet, coiling the hot-rolled sheet at a temperature not higher than 550° C., subjecting the hot-rolled sheet to cold-rolling, heating to 750° C.~$Ac_1$ point the cold-rolled sheet at a rate 20° C./s or greater in the continuous annealing line for recrystallization annealing, cooling the annealed sheet to the plating temperature at a rate 20° C./s or greater, subjecting the cooled sheet to hot-dip galvanization, and heating the galvanized sheet to a temperature not lower than 550° C. and lower than 680° C. for alloying treatment.

The process of the present invention is characterized in that cooling is carried out rapidly so as to prevent the precipitation of FeTiP. The reason why the temperatures are specified as mentioned above is explained below with reference to FIG. 1 which is a heat treatment diagram.

The billet heating temperature (SRT) should be 1100~1250° C. If it is lower than 1100° C., coarse inclusions which occurred in the casting stage remain, aggravating ductility. The lower limit should be 1100° C., preferably 1150° C. On the other hand, if the billet heating temperature exceeds 1250° C., the amount of inclusions dissolved in the steel and the amount of precipitates increase. This causes fine precipitates to occur in large amounts in the hot-rolling stage, aggravating uniform elongation. Therefore, the upper limit should be 1250° C., preferably 1200° C.

The coiling temperature (CT) is not higher than 550° C. Although the FeTiP precipitates at about 700° C. (peak temperature), FeTiP precipitates in large amounts even at a low temperature (exceeding 550° C.) if this temperature is kept for a long time. Therefore, the upper limit of CT should be 550° C., preferably not higher than 500° C.

The cold rolling is followed by recrystallization annealing, for which the cold-rolled sheet should be heated as rapidly as possible so as to prevent precipitation of FeTiP. The heating rate (HR1) should be such that the temperature passes rapidly through the range of 680~720° C. (peak temperature of FeTiP precipitation). Therefore, the HR1 should be 20° C./s or greater, preferably 35° C./s or greater, and more preferably 50° C./s or greater. If the annealing temperature is lower than 750° C., the resulting steel sheet is poor in ductility due to insufficient recrystallization. On the other, if the annealing temperature is higher than $Ac_1$ point, the resulting steel sheet undergoes transformation into austenite, becoming poor in ductility. Therefore, the lower limit of the annealing temperature should be 750° C., preferably 780° C., and the upper limit of the annealing temperature should be $Ac_1$ point.

After recrystallization annealing, the steel sheet is cooled for hot-dip galvanization at the rate of CR1. This cooling should be carried out as rapidly as possible such that the temperature passes rapidly through the range of peak temperature of FeTiP precipitation. Therefore, CR1 should be 20° C. or greater, preferably 35° C. or greater, and more preferably 50° C. or greater. Incidentally, the plating bath temperature should be 400~500° C.

The hot-dip galvanizing is followed by alloying treatment. The upper limit of the alloying treatment temperature should be lower than 680° C., preferably 650° C., so as to avoid the peak temperature region (680~720° C.) of FeTiP precipitation. If the alloying temperature is excessively low, plating adhesion is poor. Therefore, the lower limit of the alloying temperature should be 550° C. The hot-dip galvanizing temperature is raised to the alloying temperature at a rate of HR2, which is not specifically restricted because it is usually greater than 20° C./s in the continuous hot-dip galvanizing line.

The fourth aspect of the present invention is a process for producing the galvannealed steel sheet mentioned above in the first and second aspects. This process comprises heating to 1100~1250° C. a billet having the chemical composition mentioned in the first or second aspect, hot-rolling the billet, coiling the hot-rolled sheet at a temperature not higher than 550° C., subjecting the hot-rolled sheet to cold-rolling, heating to 750° C.~$Ac_1$ point the cold-rolled sheet at a rate 20° C./s or greater in the continuous annealing line for recrystallization annealing, cooling the annealed sheet to the plating temperature at a rate 20° C./s or greater, subjecting the cooled sheet to hot-dip galvanization, heating the galvanized sheet to a temperature higher than 720° C. and not higher than 800° C. for alloying treatment, and finally cooling at a rate 20° C./s or greater.

The processes in the third and fourth aspects are the same except for the alloying temperature and the restricted cooling rate CR2. These differences are explained below.

The alloying temperature higher than 720° C. and not higher than 800° C. is established so as to circumvent the peak temperature region of 680~720° C. for FeTiP precipitation. The lower limit should be higher than 720° C., preferably 740° C. or higher. If the alloying temperature exceeds 800° C., alloying proceeds too far, with the amount of Fe increasing in Zn. This leads to "powdering" which is a phenomenon that plating peels off, giving rise to powder, during pressing. The upper limit should be 800° C., preferably 780° C.

In the case where the alloying temperature exceeds 720° C., the cooling rate CR2 after alloying should be 20° C./s or greater, preferably 35° C./s or greater, and more preferably 50° C./s or greater. If cooling after alloying is slow in the peak temperature region of 680~720° C. for FeTiP precipitation, a large amount of FeTiP will precipitate.

EXAMPLES

A steel having the chemical composition shown in Table 1 was made into a billet by vacuum induction melting. The billet was heated to the billet heating temperature SRT shown in Table 2. The heated billet underwent rough rolling (30 mm t). The rough rolling was followed by finish rolling (4 mm t) at a finish rolling temperature of 900° C. The resulting hot-rolled steel sheet underwent cold rolling at a draft of 70%. The resulting cold-rolled steel sheet (1.2 mm t) underwent recrystallization annealing, hot-dip galvanizing (at 460° C.), and alloying treatment by means of the continuous hot-dip galvanizing line. Thus there was obtained a galvannealed steel sheet. Incidentally, HR1, CR1, and CR2 in Table 2 correspond to the heating rate and cooling rate explained in FIG. 1. The heating rate HR2 is not smaller than 50° C./s after hot-dip galvanizing in the continuous hot-dip galvanizing line. Therefore, HR2 is not controlled.

The galvannealed steel sheet thus obtained was visually examined for plating adhesion. It was also tested for mechanical properties by using three tensile test pieces take from each sample. (An average value of three measurements was used for evaluation.) Test pieces for TEM observation were taken from each sample, and the surface at the center of the sheet cross section was observed by replica method.

Figure 2:
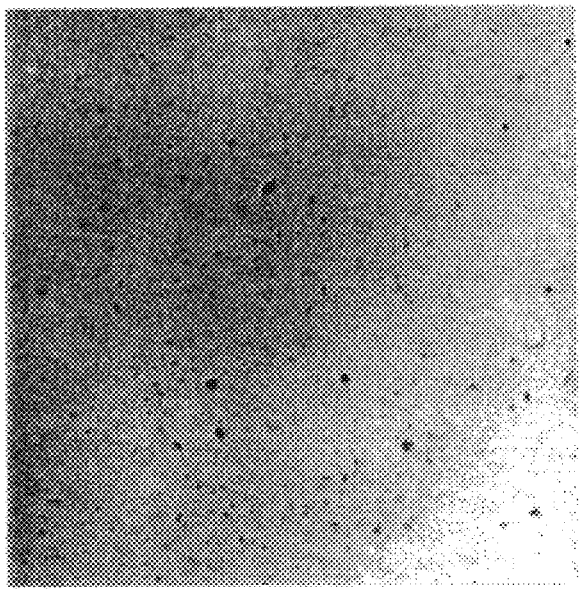
FIG. 2 is a photograph showing the surface metal structure of the cold rolled steel sheet (as the base material) in Example (sample No. 1) of the present invention.
Figure 4:
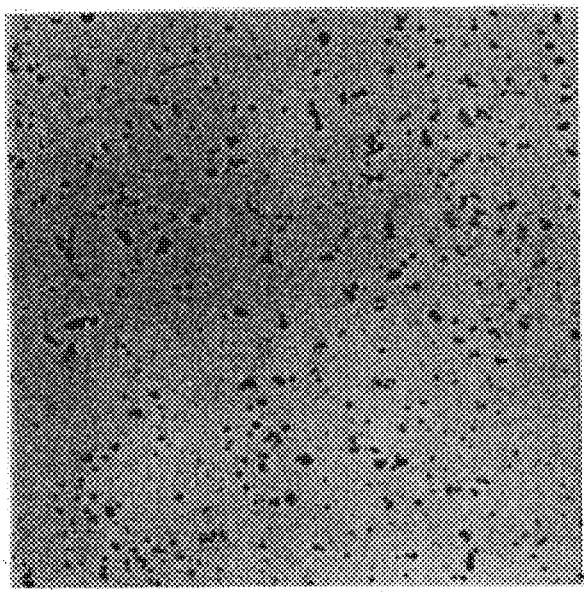
FIG. 4 is a photograph showing the surface metal structure of the cold rolled steel sheet (as the base material) in Comparative Example (sample No. 18) of the present invention.
Figure 3:
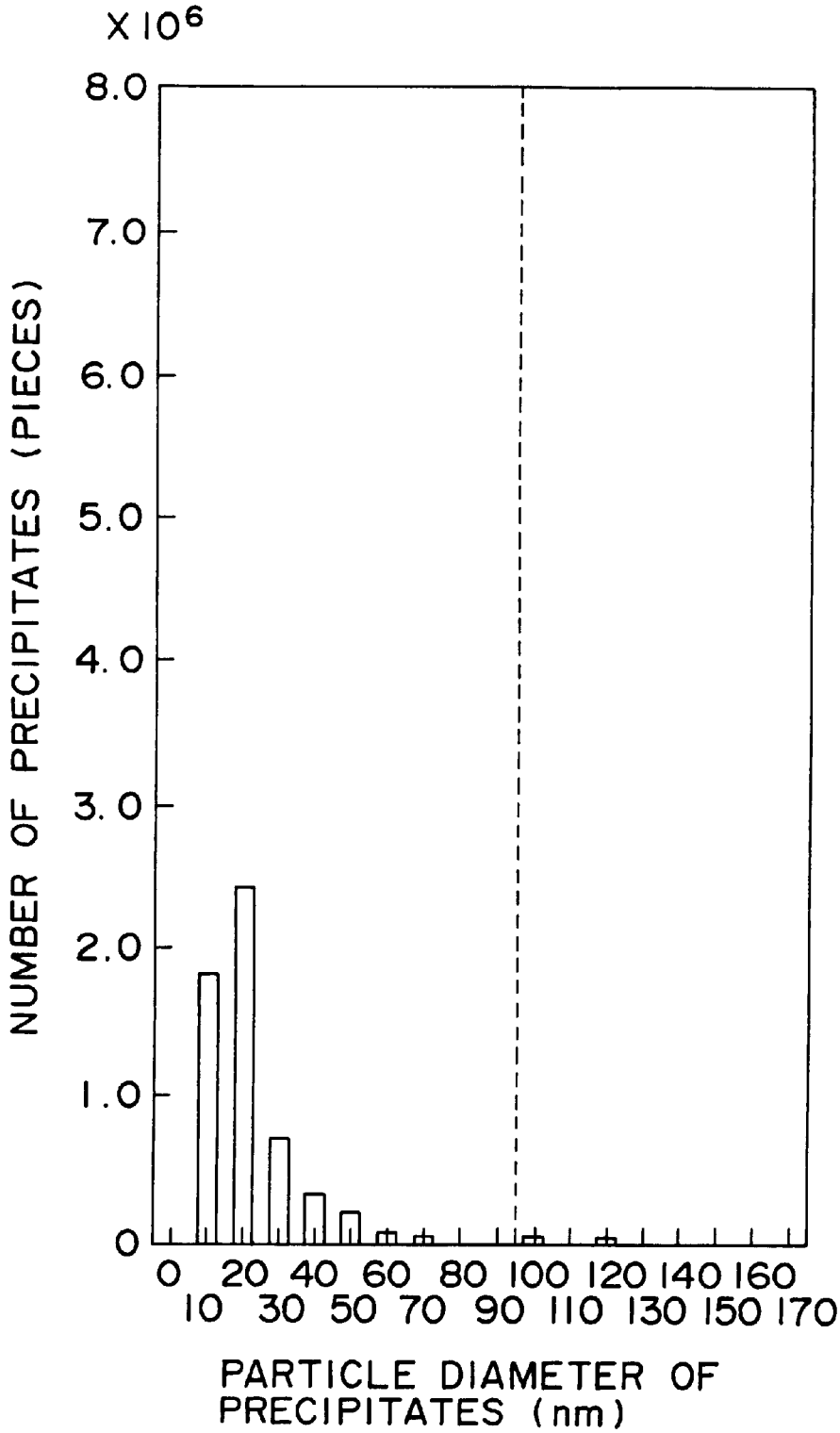
FIG. 3 is a graph showing the relation between the number and the particle diameter of inclusion in Example (sample No. 1) of the present invention.
Figure 5:
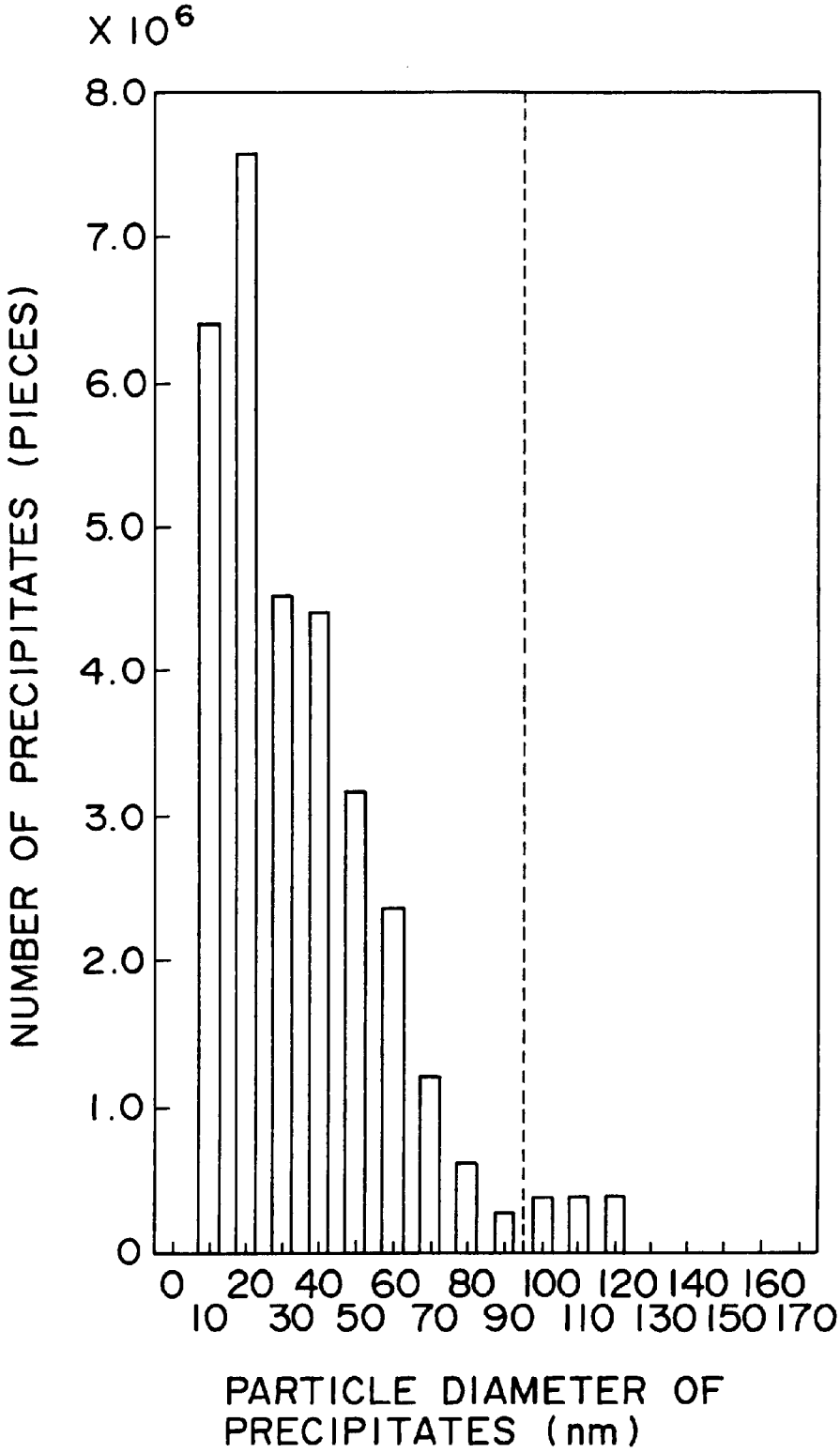
FIG. 5 is a graph showing the relation between the number and the particle diameter of inclusion in Comparative Example (sample No. 18) of the present invention.

The size and number of precipitates were measured, and the number of precipitates defined by ρ1 and ρ2 was counted. The results are shown in Table 2. The field of view for observation of precipitates is about 30 $\mu m^2$, however, the measured value is expressed in terms of the number of precipitates per $mm^2$. The photographs of surface structure (×15000) and the number of precipitates are shown in FIGS. 2 to 5. FIGS. 2 and 3 show the results obtained with Sample No. 1 in Example, and FIGS. 4 and 5 show the results obtained with Sample No. 18 in Comparative Example.

By contrast, the sample No. 3 (with the billet heating temperature exceeding the specified limit) contains a large amount of dissolved inclusion and precipitates. It gave a large amount of fine precipitates in the subsequent steps; hence it had a high value of YR and was poor in elongation. The sample No. 4 (with the billet heating temperature lower than the specified limit) contains a large amount of coarse inclusions and hence is low in elongation (particularly local elongation). The sample No. 6 (with the coiling temperature exceeding the specified limit) contains a large amount of precipitates

TABLE 1

| | Chemical composition (wt %, with remainder substantially Fe) | | | | | | | | | | Formula | |
|---|---|---|---|---|---|---|---|---|---|---|---|---|
| Steel No. | C | Si | Mn | P | S | B | Al | N | Ti | others | value | Remarks |
| A | 0.0020 | 0.1 | 1.5 | 0.10 | 0.005 | 0.0008 | 0.03 | 0.0025 | 0.04 | Nb: 0.02 | 0.00054 | * |
| B | 0.0020 | 0.1 | 1.5 | 0.10 | 0.005 | 0.0008 | 0.03 | 0.0025 | 0.06 | | 0.00074 | * |
| C | 0.0020 | 0.1 | 1.5 | 0.10 | 0.005 | 0.0008 | 0.03 | 0.0025 | 0.12 | | 0.00199 | |
| D | 0.0020 | 0.1 | 1.5 | 0.25 | 0.005 | 0.0008 | 0.03 | 0.0025 | 0.06 | | 0.00074 | |
| E | 0.0020 | 0.1 | 1.5 | 0.10 | 0.005 | 0.0008 | 0.03 | 0.0025 | 0.02 | Zr: 0.04 | 0.00035 | * |
| F | 0.0020 | 0.1 | 0.5 | 0.10 | 0.005 | 0.0008 | 0.03 | 0.0025 | 0.04 | Nb: 0.02 | 0.00054 | |
| G | 0.0020 | 0.1 | 3.5 | 0.10 | 0.005 | 0.0008 | 0.03 | 0.0025 | 0.04 | Nb: 0.02 | 0.00054 | |
| H | 0.0100 | 0.1 | 1.5 | 0.10 | 0.005 | 0.0008 | 0.03 | 0.0025 | 0.08 | | 0.00049 | |
| I | 0.0020 | 0.1 | 1.5 | 0.10 | 0.005 | 0.0008 | 0.03 | 0.0025 | 0.00 | | −0.00050 | |
| J | 0.0020 | 0.1 | 1.5 | 0.10 | 0.005 | — | 0.03 | 0.0025 | 0.04 | Nb: 0.02 | 0.00055 | * |

Note:
Formula = T/48 + Zr/91 + Nb/93 − C/12 − N/14 − S/32
Remarks: * the steel pertaining to the present invention.

TABLE 2

| | | | | Anneal | | Alloying | | | Mechanical properties | | | | | | | | | |
|---|---|---|---|---|---|---|---|---|---|---|---|---|---|---|---|---|---|---|
| Sample No. | Steel No. | SRT ° C. | CT ° C. | Temp. ° C. | HR1 ° C./s | Temp. ° C./s | CR1 ° C./s | CR2 ° C./s | YP MPa | TS MPa | El % | Elu % | Ell % | TS × El MPa | P1 ×10⁶ | P2 ×10⁵ | Plating adhesion | Note |
| 1 | A | 1150 | 500 | 800 | 50 | 600 | 20 | 20 | 300 | 450 | 40 | 24 | 16 | 180.0 | 5.6 | 1.2 | good | * |
| 2 | A | 1250 | 500 | 800 | 50 | 600 | 20 | 20 | 310 | 450 | 40 | 24 | 15 | 179.4 | 6.2 | 1.0 | good | * |
| 3 | A | 1350 | 500 | 800 | 50 | 600 | 20 | 20 | 360 | 460 | 35 | 20 | 15 | 161.0 | 17.5 | 1.5 | good | ** |
| 4 | A | 1050 | 500 | 800 | 50 | 600 | 20 | 20 | 280 | 420 | 37 | 24 | 13 | 155.4 | 6.0 | 6.1 | good | ** |
| 5 | A | 1150 | 400 | 800 | 50 | 600 | 20 | 20 | 300 | 450 | 40 | 24 | 16 | 180.0 | 4.2 | 1.0 | good | * |
| 6 | A | 1150 | 600 | 800 | 50 | 600 | 20 | 20 | 320 | 450 | 36 | 21 | 15 | 162.0 | 21.7 | 2.2 | good | ** |
| 7 | A | 1150 | 500 | 700 | 50 | 600 | 20 | 20 | 400 | 500 | 28 | 16 | 12 | 140.0 | 26.2 | 1.5 | good | ** |
| 8 | A | 1150 | 500 | 900 | 50 | 600 | 20 | 20 | 340 | 480 | 30 | 17 | 13 | 144.0 | 8.1 | 2.1 | good | ** |
| 9 | A | 1150 | 400 | 800 | 30 | 600 | 20 | 20 | 300 | 450 | 39 | 24 | 15 | 175.5 | 5.0 | 1.1 | good | * |
| 10 | A | 1150 | 400 | 800 | 10 | 600 | 20 | 20 | 320 | 455 | 36 | 22 | 14 | 183.8 | 12.1 | 1.6 | good | ** |
| 11 | A | 1150 | 500 | 800 | 50 | 650 | 20 | 20 | 290 | 460 | 39 | 24 | 15 | 179.4 | 7.1 | 1.2 | good | * |
| 12 | A | 1150 | 500 | 800 | 50 | 700 | 20 | 20 | 300 | 450 | 35 | 20 | 15 | 157.9 | 15.9 | 2.1 | good | ** |
| 13 | A | 1150 | 500 | 800 | 50 | 750 | 20 | 20 | 300 | 450 | 39 | 24 | 15 | 175.5 | 9.2 | 3.6 | good | * |
| 14 | A | 1150 | 500 | 800 | 50 | 500 | 20 | 20 | 300 | 450 | 39 | 24 | 15 | 175.5 | 7.1 | 2.4 | poor | ** |
| 15 | A | 1150 | 500 | 800 | 50 | 750 | 20 | 10 | 310 | 455 | 35 | 20 | 15 | 159.3 | 19.9 | 2.7 | good | ** |
| 16 | A | 1150 | 500 | 800 | 50 | 600 | 10 | 20 | 300 | 450 | 36 | 21 | 15 | 162.0 | 13.8 | 1.8 | good | ** |
| 17 | B | 1150 | 500 | 800 | 50 | 600 | 20 | 20 | 300 | 440 | 40 | 24 | 16 | 176.0 | 8.2 | 3.1 | good | * |
| 18 | C | 1150 | 500 | 800 | 50 | 600 | 20 | 20 | 290 | 460 | 34 | 19 | 13 | 156.4 | 37.0 | 9.4 | good | ** |
| 19 | D | 1150 | 500 | 800 | 50 | 600 | 20 | 20 | 300 | 510 | 29 | 17 | 12 | 147.9 | 41.5 | 11.1 | good | ** |
| 20 | E | 1150 | 500 | 800 | 50 | 600 | 20 | 20 | 280 | 440 | 39 | 25 | 14 | 171.6 | 1.2 | 0.0 | good | * |
| 21 | F | 1150 | 500 | 800 | 50 | 600 | 20 | 20 | 200 | 335 | 45 | 27 | 18 | 150.8 | 4.8 | 1.4 | good | ** |
| 22 | G | 1150 | 500 | 800 | 50 | 600 | 20 | 20 | 380 | 550 | 32 | 20 | 12 | 176.0 | 5.2 | 1.2 | poor | ** |
| 23 | H | 1150 | 500 | 800 | 50 | 600 | 20 | 20 | 290 | 460 | 33 | 20 | 13 | 151.8 | 22.3 | 7.3 | good | ** |
| 24 | I | 1150 | 500 | 800 | 50 | 600 | 20 | 20 | 290 | 430 | 35 | 22 | 13 | 150.5 | 3.5 | 0.9 | good | ** |
| 25 | J | 1150 | 500 | 800 | 50 | 600 | 20 | 20 | 300 | 450 | 39 | 24 | 15 | 175.5 | 4.5 | 1.5 | good | * |

*Working Examples
**Comparative Examples

It is noted from Table 2 that the samples pertaining to the present invention has the values of ρ1 and ρ2 which are within the prescribed range. They have high strength and also have high values of both E1u and E1l. They have good ductility suitable for press working. Yet, they have a low value of YR (yield ratio=YP/TS).

The sample No. 7 with a low annealing temperature) has the unrecrystallized structure. The ample No. 8 (with a high annealing temperature) experienced austenitic transformation during annealing, and hence it is extremely low in El. The sample No. 12 (with an alloying temperature of 700° C.) contains a large amount of precipitates corresponding to ρ1 and hence remarkably poor in Elu. The sample No. 14 (with an alloying temperature of 500° C.) is poor in plating adhesion. The sample No. 10 (with a small heating rate of H1 for annealing) contains a large amount of precipitates corresponding to ρ1 and hence remarkably poor in Elu. This holds true for the sample No. 16 (with a small cooling rate CR1 from annealing temperature to plating temperature) and the sample No. 15 (with a small cooling rate CR2 from alloying temperature).

[Effect of the invention] According to the present invention, the galvannealed steel sheet has high strength and good ductility (with balanced uniform elongation and local elongation) and hence is suitable for press working, despite the fact it is made of a cold-rolled steel sheet (as the base material) which contains both P and Ti. The reason for this is that the amount of inclusions (which are mainly FeTiP precipitates) in the steel is controlled according to their size. According to the process of the present invention, the alloying is carried out at a temperature outside the peak temperature range of FeTiP precipitation, and the steel sheet is heated and cooled at an adequate rate in that range. Therefore, the present invention permits easy production of galvannealed steel sheet superior in ductility.

What is claimed is:

1. A galvannealed steel sheet superior in ductility which is made of a cold-rolled steel sheet and has alloyed hot-dip galvanizing on the surface thereof, said cold-rolled steel sheet having the chemical composition (in terms of wt %) of:

C: less than 0.010%,

Si: no more than 0.5%,

Mn: 1.0~3.0%,

P: no more than 0.20%,

S: no more than 0.01%,

Al: 0.005~0.10%,

N: no more than 0.0050%,

Ti/48−(C/12+N/14+S/32):0.0003~0.0018 with the remainder being chiefly Fe, and said cold-rolled steel sheet being characterized by:

$\rho 1 \leqq 10^7$ and $\rho 2 \leqq 5\times10^5$, where ρ1 is the number of precipitates whose particle diameter (D) is in the range of 10 nm≦D<100 nm and ρ2 is the number of precipitates whose particle diameter (D) is in the range of 100 nm≦D.

2. A galvannealed steel sheet superior in ductility which is made of a cold-rolled steel sheet and has alloyed hot-dip galvanizing on the surface thereof, said cold-rolled steel sheet having the chemical composition (in terms of wt %) of:

C: less than 0.010%,

Si: no more than 0.5%,

Mn: 1.0~3.0%,

P: no more than 0.20%,

S: no more than 0.01%,

Al: 0.005~0.10%,

N: no more than 0.0050%,

Zr: no more than 0.10% and/or Nb: no more than 0.10%,

Ti/48+Zr/91+Nb/93−(C/12+N/14+S/32):0.0003~0.0018 with the remainder being chiefly Fe, and said cold-rolled steel sheet being characterized by:

$\rho 1 \leqq 10^7$ and $\rho 2 \leqq 5\times10^5$, where ρ1 is the number of precipitates whose particle diameter (D) is in the range of 10 nm≦D<100 nm and ρ2 is the number of precipitates whose particle diameter (D) is in the range of 100 nm≦D.

3. A galvannealed steel sheet superior in ductility as defined in claim 1, wherein the cold-rolled steel sheet as the base material contains 0.0002~0.0030% of B as an additional component has a tensile strength of 340~590 MPa.

4. A galvannealed steel sheet superior in ductility as defined in claim 2, wherein the cold-rolled steel sheet as the base material contains 0.0002~0.0030% of B as an additional component has a tensile strength of 340~590 MPa.

5. A process which comprises heating to 1100~1250° C. a billet having the chemical composition defined in claim 1, hot-rolling the billet, coiling the hot-rolled sheet at a temperature not higher than 550° C., subjecting the hot-rolled sheet to cold-rolling, heating to 750° C.~$Ac_1$ point the cold-rolled sheet at a rate 20° C./s or greater in the continuous annealing line for recrystallization annealing, cooling the annealed sheet to the plating temperature at a rate 20° C./s or greater, subjecting the cooled sheet to hot-dip galvanization, and heating the galvanized sheet to a temperature not lower than 550° C. and lower than 680° C. for alloying treatment.

6. A process which comprises heating to 1100~1250° C. a billet having the chemical composition defined in claim 2, hot-rolling the billet, coiling the hot-rolled sheet at a temperature not higher than 550° C., subjecting the hot-rolled sheet to cold-rolling, heating to 750° C.~$Ac_1$ point the cold-rolled sheet at a rate 20° C./s or greater in the continuous annealing line for recrystallization annealing, cooling the annealed sheet to the plating temperature at a rate 20° C./s or greater, subjecting the cooled sheet to hot-dip galvanization, and heating the galvanized sheet to a temperature not lower than 550° C. and lower than 680° C. for alloying treatment.

7. A process which comprises heating to 1100~1250° C. a billet having the chemical composition defined in claim 1, hot-rolling the billet, coiling the hot-rolled sheet at a temperature not higher than 550° C., subjecting the hot-rolled sheet to cold-rolling, heating to 750° C.~$Ac_1$ point the cold-rolled sheet at a rate 20° C./s or greater in the continuous annealing line for recrystallization annealing, cooling the annealed sheet to the plating temperature at a rate 20° C./s or greater, subjecting the cooled sheet to hot-dip galvanization, heating the galvanized sheet to a temperature higher than 720° C. and not higher than 800° C. for alloying treatment, and finally cooling at a rate 20° C./s or greater.

8. A process which comprises heating to 1100~1250° C. a billet having the chemical composition defined in claim 2, hot-rolling the billet, coiling the hot-rolled sheet at a temperature not higher than 550° C., subjecting the hot-rolled sheet to cold-rolling, heating to 750° C.~$Ac_1$ point the cold-rolled sheet at a rate 20° C./s or greater in the continuous annealing line for recrystallization annealing, cooling the annealed sheet to the plating temperature at a rate 20° C./s or greater, subjecting the cooled sheet to hot-dip galvanization, heating the galvanized sheet to a temperature higher than 720° C. and not higher than 800° C. for alloying treatment, and finally cooling at a rate 20° C./s or greater.

* * * * *

UNITED STATES PATENT AND TRADEMARK OFFICE

CERTIFICATE OF CORRECTION

PATENT NO. : 6,316,127 B1
DATED : November 13, 2001
INVENTOR(S) : Ikeda et al.

It is certified that error appears in the above-identified patent and that said Letters Patent is hereby corrected as shown below:

Title page, Item [54] and Column 1,
The title page should be:
-- [54] GALVANNEALED STEEL SHEET SUPERIOR IN DUCTILITY AND PROCESS FOR PRODUCTION THEREOF --
Item [73], Assignee's information should read:
-- [73] Assignee: Kabushiki Kaisha Kobe Seiko Sho (Kobe Steel Ltd.), Kobe-shi (JP) --

Signed and Sealed this

Eleventh Day of June, 2002

*Attest:*

*Attesting Officer*

JAMES E. ROGAN
*Director of the United States Patent and Trademark Office*